US010612201B2

(12) United States Patent
Baek

(10) Patent No.: US 10,612,201 B2
(45) Date of Patent: Apr. 7, 2020

(54) SHOCK-ABSORBING BARRIER USING PILLARS AND RAIL

(71) Applicant: Kyoungpa Baek, Seoul (KR)

(72) Inventor: Kyoungpa Baek, Seoul (KR)

( * ) Notice: Subject to any disclaimer, the term of this patent is extended or adjusted under 35 U.S.C. 154(b) by 186 days.

(21) Appl. No.: 15/669,924

(22) Filed: Aug. 5, 2017

(65) Prior Publication Data

US 2017/0335528 A1 Nov. 23, 2017

Related U.S. Application Data

(63) Continuation-in-part of application No. PCT/KR2016/003167, filed on Apr. 17, 2016.

(30) Foreign Application Priority Data

Jun. 24, 2015 (KR) ..... 10-2015-0089368

(51) Int. Cl.
*E01F 15/02* (2006.01)
*E01F 15/04* (2006.01)
*E01F 15/14* (2006.01)

(52) U.S. Cl.
CPC ..... *E01F 15/025* (2013.01); *E01F 15/0415* (2013.01); *E01F 15/0438* (2013.01); *E01F 15/0461* (2013.01); *E01F 15/141* (2013.01)

(58) Field of Classification Search
CPC ..... E01F 15/02; E01F 15/025; E01F 15/04; E01F 15/0407; E01F 15/0415; E01F 15/0438; E01F 15/0461; E01F 15/08; E01F 15/088; E01F 15/145; E01F 15/146
See application file for complete search history.

(56) References Cited

U.S. PATENT DOCUMENTS 8,282,082 B2 * 10/2012 An ..... E01F 15/025 256/13.1
8,434,965 B2 * 5/2013 Chae ..... E01F 15/025 256/13.1

FOREIGN PATENT DOCUMENTS

KR 10-1997-0062203 A 9/1997
KR 10-1240560 * 3/2013 ..... E01F 15/14
KR 10-1250343 * 4/2013 ..... E01F 15/02
KR 10-1303080 * 9/2013 ..... E01F 15/02

* cited by examiner

*Primary Examiner* — Michael P Ferguson
(74) *Attorney, Agent, or Firm* — Mark M. Friedman

(57) ABSTRACT

Disclosed is a shock-absorbing barrier. According to the present invention, the shock-absorbing barrier is configured wherein guardrails onto which shock-absorbing members like waste tires or waste rubber are mounted are attached to barrier walls and pillar bodies made by attaching pillar tubes to pillars are connectedly erected by means of the barrier walls on which the guardrails are mounted, so that if an external collision occurs, rotary rods are changed to a shape of a cone around the axis of the pillar tube rail to extend a shock-absorbing section, and the external collision is distributed by the compression and tension of both side rails to decrease the deviation displacement of the barrier wall boundary and to allow the pressure of the collision portion to be distributedly absorbed to the parts connected by the guardrails.

5 Claims, 8 Drawing Sheets

SHOCK-ABSORBING BARRIER USING PILLARS AND RAIL

CROSS-REFERENCE TO RELATED APPLICATIONS

This application is a Continuation-In-Part (CIP) of International Patent Application No. PCT/KR2016/003167 filed on Apr. 17, 2016, which claims priority to Korean Patent Application No. 10-2015-0089368 filed on Jun. 24, 2015, the entire contents of which are incorporated by reference herein.

FIELD OF THE INVENTION

The present invention relates to a shock-absorbing barrier, and more particularly, to a shock-absorbing barrier using pillars and rails that has shock-absorbing effects and rigidity adequate to the shape of a road.

BACKGROUND

A conventional guardrail used on a road is configured to have pillars fixed to the ground so that shock-absorbing effects upon the occurrence of collisions are not exerted well to cause frequent human life damages, and further, connection members are broken when accidents happen, which often leads to large-scale accidents. In conventional practices, on the other hand, a guardrail has been proposed to have double foldable collision parts disposed thereon to perform shock absorption, but in this case, a plurality of fixed pillars is located to cause the shock-absorbing effects to become weak. In addition, most of steel guardrails are fixed to the ground by means of concrete blocks, so that it is hard to install the guardrails and change the positions of the installed guardrails, long construction duration is needed, and an installation cost is increased. Contrarily, a plastic barrier having specific stiffness is weak in rigidity so that there is a limit in application of a road and accordingly, it is used only in a restricted section of the road.

SUMMARY

Accordingly, the present invention has been made in view of the above-mentioned problems occurring in the prior art, and it is an object of the present invention to provide a shock-absorbing barrier that is applicable to a variety of road sections, while strengthening shock-absorbing effects and rigidity thereof.

To accomplish the above-mentioned object, according to the present invention, there is provided a shock-absorbing barrier including: a guardrail shock-absorbing part having guardrails, to which shock-absorbing members are fastened, connected to vertical tubes on transverse axes, and rail type members mounted on barrier walls disposed on the sides of the shock-absorbing members in such a manner as to be coupled to horizontal shaft fixing rods of the vertical tubes; a pillar body constituting part having a pillar tube rail connected on a transversely long axis to a pillar tube coupled to the upper portion of a pillar; and a guardrail constituting part having rotary rods coupled vertically to the pillar tube rail and the guardrails and a barrier wall connecting and erecting body made by passing and erecting the rail type members through the barrier walls or by attaching and erecting the rail type members to the barrier walls.

BRIEF DESCRIPTION OF THE DRAWINGS

The above and other objects, features and advantages of the present invention will be apparent from the following detailed description of the preferred embodiments of the invention in conjunction with the accompanying drawings, in which.

DETAILED DESCRIPTION OF THE PREFERRED EMBODIMENTS

Now, an explanation on a shock-absorbing barrier according to the present invention will be given with reference to the attached drawings.

Figure 1:
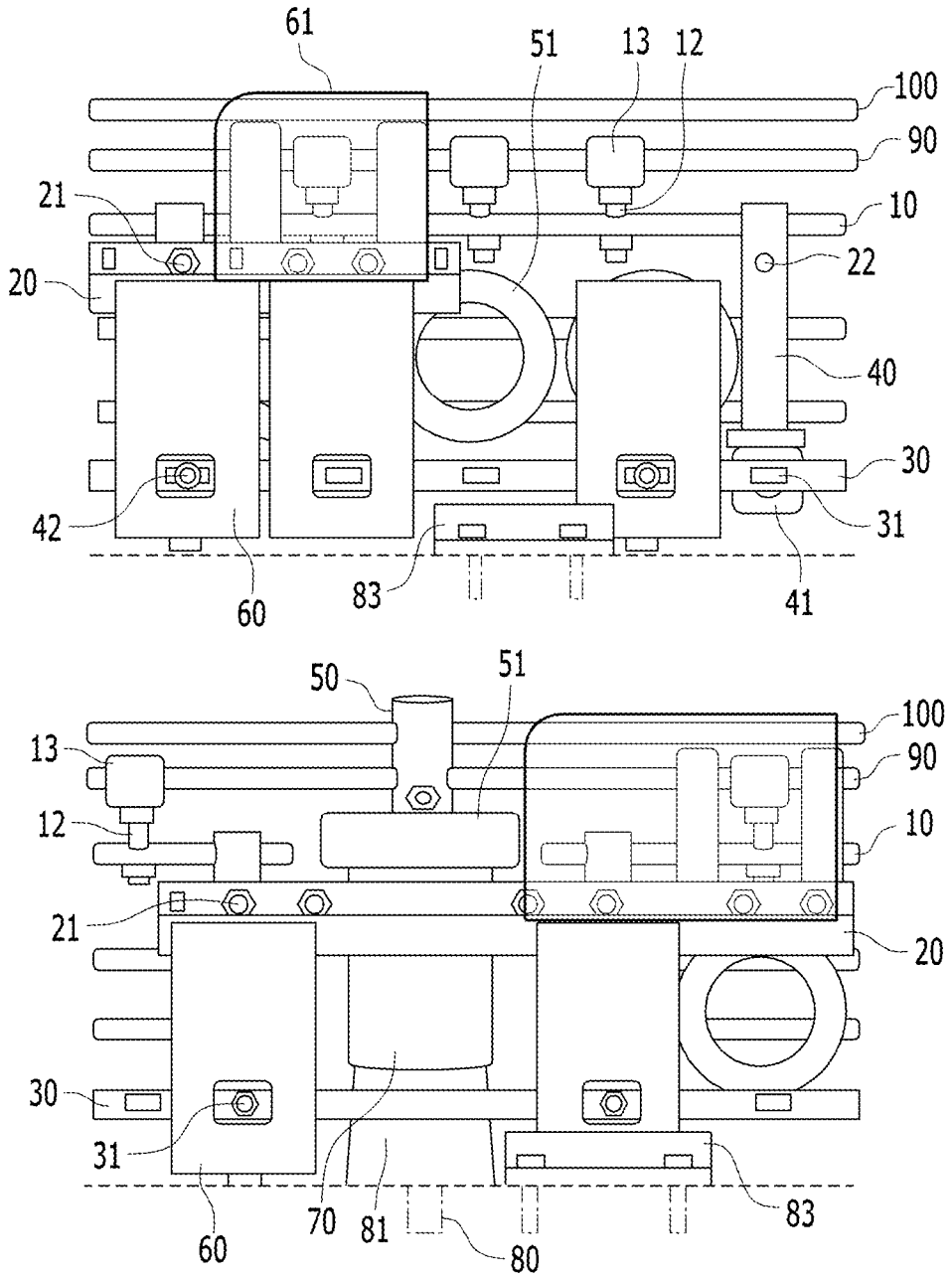
FIG. 1 is a front view showing the installation state of a shock-absorbing barrier according to the present invention.

FIG. 1 is a front view showing the installation state of a shock-absorbing barrier according to the present invention, and the shock-absorbing barrier according to the present invention includes: a guardrail shock-absorbing part having guardrails 10, to which shock-absorbing members 51 are fastened, connected to vertical tubes 40 on transverse axes, and rail type members mounted on barrier walls 60 disposed on the sides of the shock-absorbing members 51 in such a manner as to form fastening portions to horizontal shaft fixing rods 21 passing through fixed holes 22 of the vertical tubes 40 to form a line of the shock-absorbing barrier; a pillar body constituting part having a pillar tube rail 90 connected on a transversely long axis to a pillar tube 50 coupled to the upper portion of a pillar 80; and a guardrail constituting part having rotary rods 12 coupled vertically to the guardrails 10 in such a manner as to connect the pillar tube rail 90 and the guardrails 10 with each other so as to allow the guardrail shock-absorbing part to be vertical to the ground and a barrier wall connecting and erecting body made by passing and erecting the rail type members through the barrier walls 60 or by attaching and erecting the rail type members to the barrier walls 60.

Figure 2A:
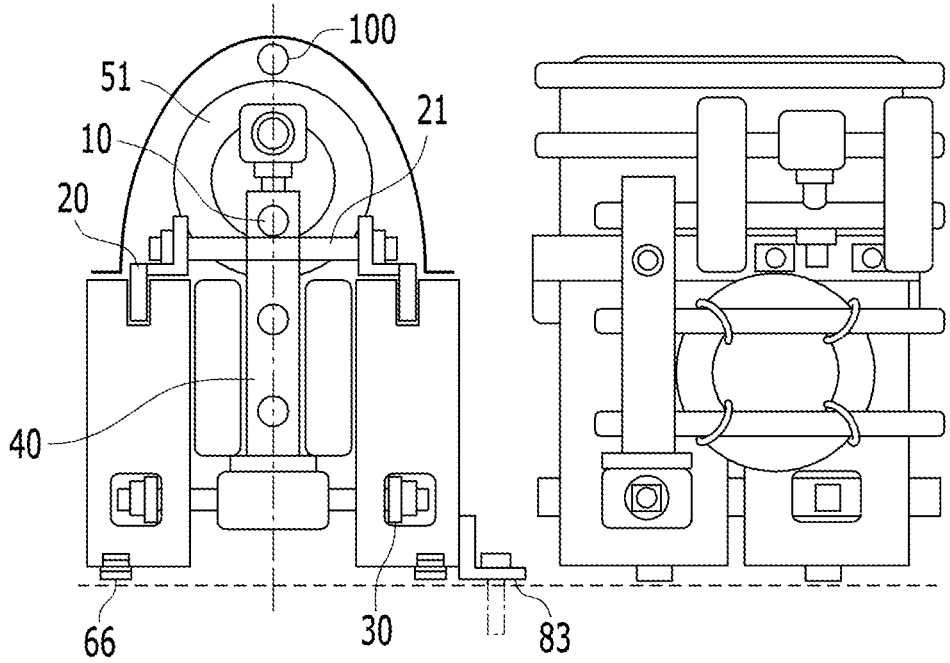
FIG. 2A is a side sectional view showing the guardrail shock-absorbing part of the shock-absorbing barrier according to the present invention.

FIG. 2A is a side sectional view showing the guardrail shock-absorbing part of the shock-absorbing barrier according to the present invention. Referring to FIG. 2A, the rail type members have horizontal rails 30 adapted to erectedly pass through the barrier walls 60 and having horizontal holes 31 formed thereon in such a manner as to be fastened to horizontal rods 42. Straight type rail grooves 65 are formed on the top surfaces of the barrier walls 60 erectedly connected with each other by means of the rail type members to insert barrier rails 20 thereinto, and further, cover holes 67 are formed on the top surfaces of the barrier walls 60 to attach a water-proof cover and an external cover 61 thereto. Furthermore, vertical bolts 66 having springs are disposed on the underside surfaces of the barrier walls 60 to adjust the heights of the barrier walls 60.

Both ends of each guardrail 10 pass through the vertical tubes 40 and are then extendedly overlaid with adjacent guardrails 10 thereto, and waste tires are attached to the front surfaces of the guardrails 10 that become shock-absorbing portions and tightly fastened to the guardrails 10 by means of fastening means like wires or steel rings. Both ends of each horizontal rod 42 around a horizontal rod socket 41 coupled to the lower portion of each vertical tube 40 as a basic part of the guardrails 10 are fixed by means of nuts to coupling portions of both sides of the horizontal hole 31 of each horizontal rail 30 erectedly passing through the barrier walls 60, so that the barrier wall connecting and erecting body supports the guardrail shock-absorbing part.

So as to prevent the barrier walls 60 from being overturned, the barrier rails 20 are inserted into the rail grooves 65 transversely formed on the centers of the top surfaces of the barrier walls 60 to connect and erect the barrier walls 60, and both ends of each fixing rod 21 passing through the fixed hole 22 of each vertical tube 40 are fastened by means of nuts to both side fastening holes of the barrier rails 20, while other fastenable fixing rods 21 are passing through the space between the top end portions and the intermediate end portions of the guardrails 10 at given intervals so that their both ends are fixed by means of nuts to fastening holes of the barrier rails 20.

Figure 2B:
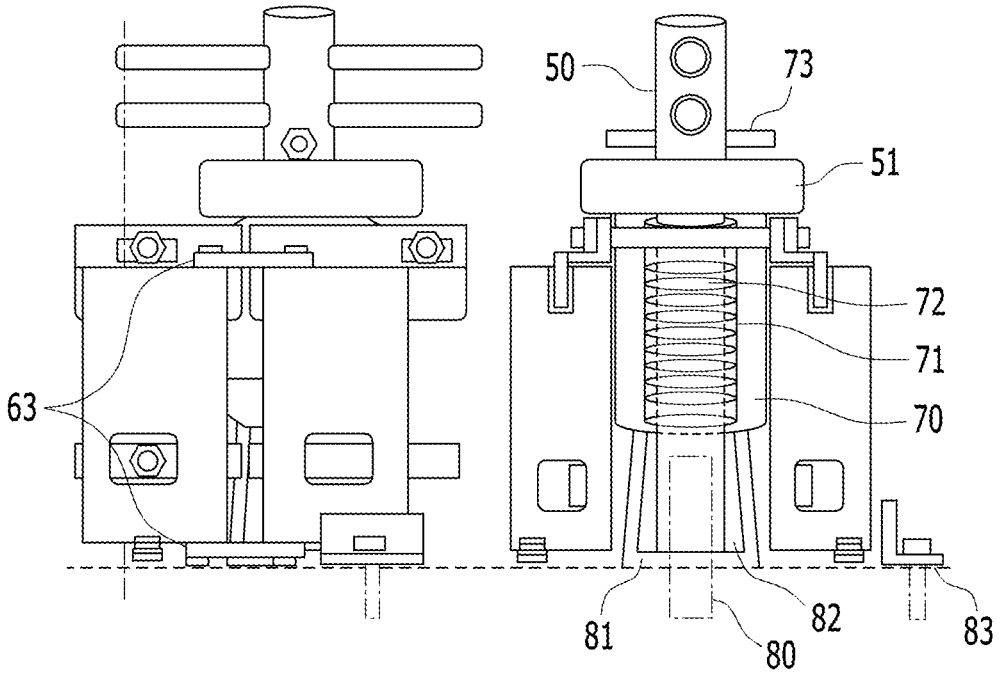
FIG. 2B is a front side view showing the pillar body constituting part of the shock-absorbing barrier according to the present invention.

FIG. 2B is a front side view showing the pillar body constituting part of the shock-absorbing barrier according to the present invention. Referring to FIG. 2B, if the embedded pillar 80 is used as a support for the pillar tube 50, the pillar tube 50 is coupled vertically to the embedded pillar 80 inserted into a hollow portion of a fixing tube body 81, and in the state where the hollow portion is filled with a fixture 82 like concrete or cement and fixed to the pillar tube 50, waste tire connecting and erecting bodies having recovering materials 71 are laminatedly fitted to the pillar tube 50. Both ends of each fixing rod 21 inserted into the through portions of the barrier rails 20 and the horizontal rails 30 disposed on both side barrier walls 60 adjacent to each other are fixed to serve as the support for the barrier wall connecting and erecting body.

The waste tire connecting and erecting bodies laminatedly fitted to the pillar tube 50 include the recovering materials 71 into which elastic coils 72 are embedded to provide elastic forces restored from the compressed shapes of the barrier walls 60 toward the center axis of the pillar tube 50, and desirably, the recovering materials 71 of the waste tire connecting and erecting bodies are packaged to the shape of a shock-absorbing bumper 70. In the state where the waste tire connecting and erecting bodies are laminatedly fitted to the pillar tube 50, a compression rod 73 is inserted into the pillar tube 50 to prevent the waste tire connecting and erecting bodies from being deviated from the pillar tube 50.

At the step wherein the guardrail shock-absorbing part and the pillar constituting part are connected to each other, the upper ends of the rotary rods 12 are insertedly connected to the shape of 'T' to the hollow portions of the pillar tube rail 90 overlaid therewith, and otherwise, they are connected to the form of bolts to the rotary rod sockets 13 in which the pillar tube rail 90 is disposed, and next, the lower ends of the rotary rods 12 are nut-fixed to the bottom ends of the through portions of the guardrail 10 so as to allow the guardrail shock-absorbing part to have vertical tension.

If the external cover 61 is fastened to the guardrail constituting part, before the rotary rods 12 are located, the shock-absorbing members 51, which have a given shape capable of accommodating the upper end portion of the guardrail 10 and the pillar tube rail 90 therein, are appropriately disposed and then fastened to the pillar tube rail 90. A cover rail 100 passes through the uppermost through hole of the pillar tube 50 to form the cover line which becomes the base of the shape for the external cover 61. Next, the water-proof cover made of an appropriate material is covered on the external cover 61, and both ends of the external cover 61 are bolt-fixed to the top surfaces of the barrier walls 60.

Figure 3:
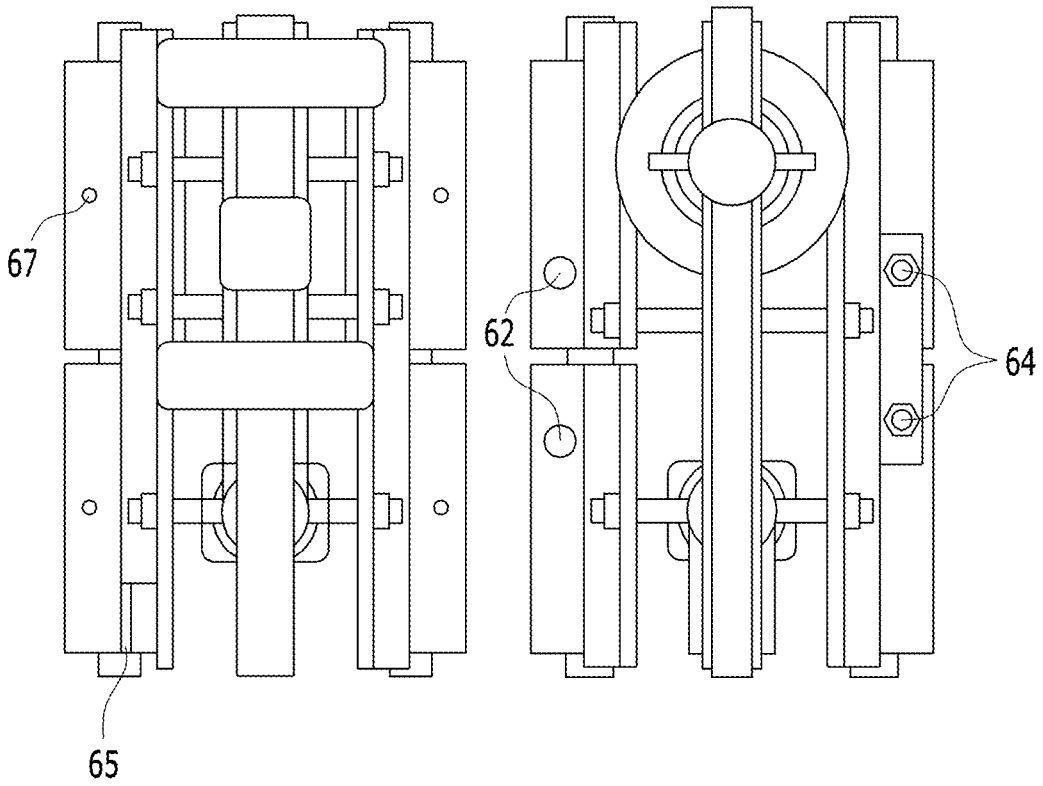
FIG. 3 is a top view showing the guardrail constituting part and the pillar body constituting part of the shock-absorbing barrier according to the present invention.

Referring to the guardrail constituting part from the top view of FIG. 3, the cover holes 67 are formed on the top surfaces of the barrier walls 60 in such a manner as to fasten the external cover 61 thereto, and advertisement windows are attached to the front surface of the external cover 61. Otherwise, the external cover 61 is semitransparent. Further, the external cover 61 has an accessory insertion space formed on the uppermost portion thereof so as to insert an accessory like a warning light or guide sign light thereinto.

Referring to the pillar body constituting part from the top view of FIG. 3, if the connected and erected barrier walls 60 are installed in a curved section, vertical bars 64 are inserted into vertical holes 62 formed on the top surfaces of the barrier walls 60 adjacent to each other and are then fastened to each other by means of a connection rod 63. In this case, the number of pillar bodies and the positions of the pillar bodies are determined in proportion to the curved angle of the road, thereby minimizing the application range thereof.

Figure 4:
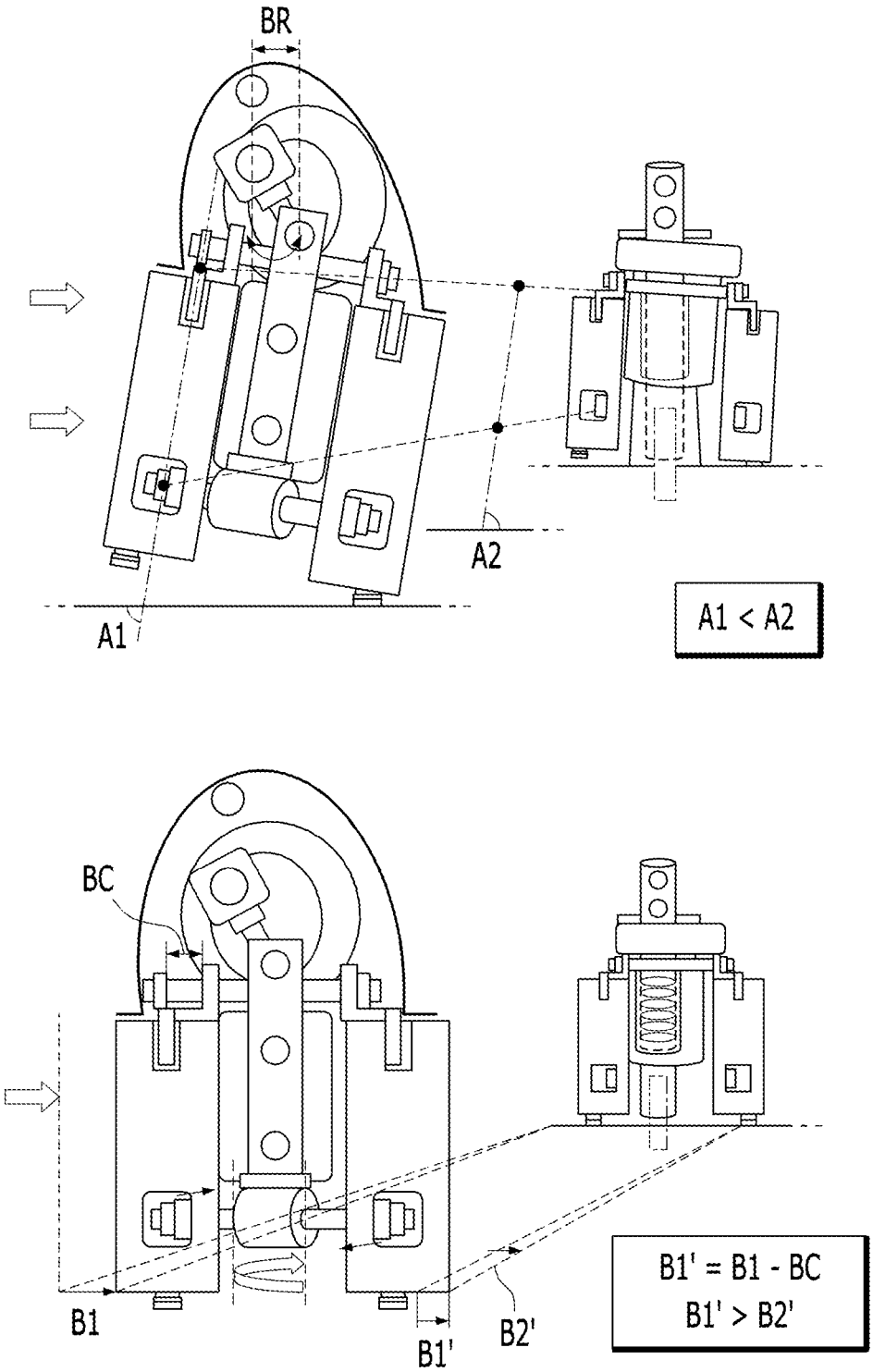
FIG. 4 is an exemplary view showing the comparison between a collision part ground surface acute angle and deviation displacement in the shock-absorbing barrier according to the present invention.

FIG. 4 is an exemplary view showing the comparison between a ground surface internal angle of a barrier wall rail and a deviation displacement of a barrier rail boundary if a collision occurs on the guardrail constituting part of the shock-absorbing barrier according to the present invention.

In the figure, at this time, A1 indicates a ground surface internal angle of the barrier wall rail, A2 a ground surface internal angle at a collision advancement point of A1, BR horizontal deviation displacement of the guardrail center axis, B1 deviation displacement of the barrier wall rail, B1' deviation displacement of the opposite side of B1, B2' deviation displacement of the advancing portion of the B1', and BC a compression section of the shock-absorbing members.

If an external collision is concentratedly applied to the upper portion of the guardrail, the rotary rods 12 are changed to the shape of cone around the axis of the pillar tube rail 90, and accordingly, the external collision is absorbed by means of the tension between the pillar tube rail 90 and the barrier wall rail. Next, the horizontal rods 42 located under the vertical tubes 40 rotate to the collision direction to cause the horizontal rails 30 fastened to both sides of the horizontal rods 42 to be twisted, so that the compressed sections are shear-deformed to shock the external collision and the deviation section of the barrier wall boundary is reduced.

Further, the barrier rails 20 or the horizontal rails 30 connected by means of the rail type members to both sides of the collision portions of the barrier walls 60 with respect to the adjacent pillars provide elastic forces to perform the shock absorption with the restoring tension proportional to the applied shock, so that the ground surface acute angle of the barrier walls 60 becomes stably vertical as approaches the pillar bodies. If the external force is applied parallel to the barrier walls 60, the shock-absorbing effects becomes high so that the compression sections of the shock-absorbing members 51 become large and the deviation displacement of the opposite side portions thereto becomes reduced.

In the section wherein it is impossible to expect a ground surface internal angle or the stiffness of the barrier walls 60 is required, moreover, a line support stand 83 is located on the barrier wall boundary to prevent the barrier walls 60 from being deviated from the barrier wall boundary.

Figure 5:
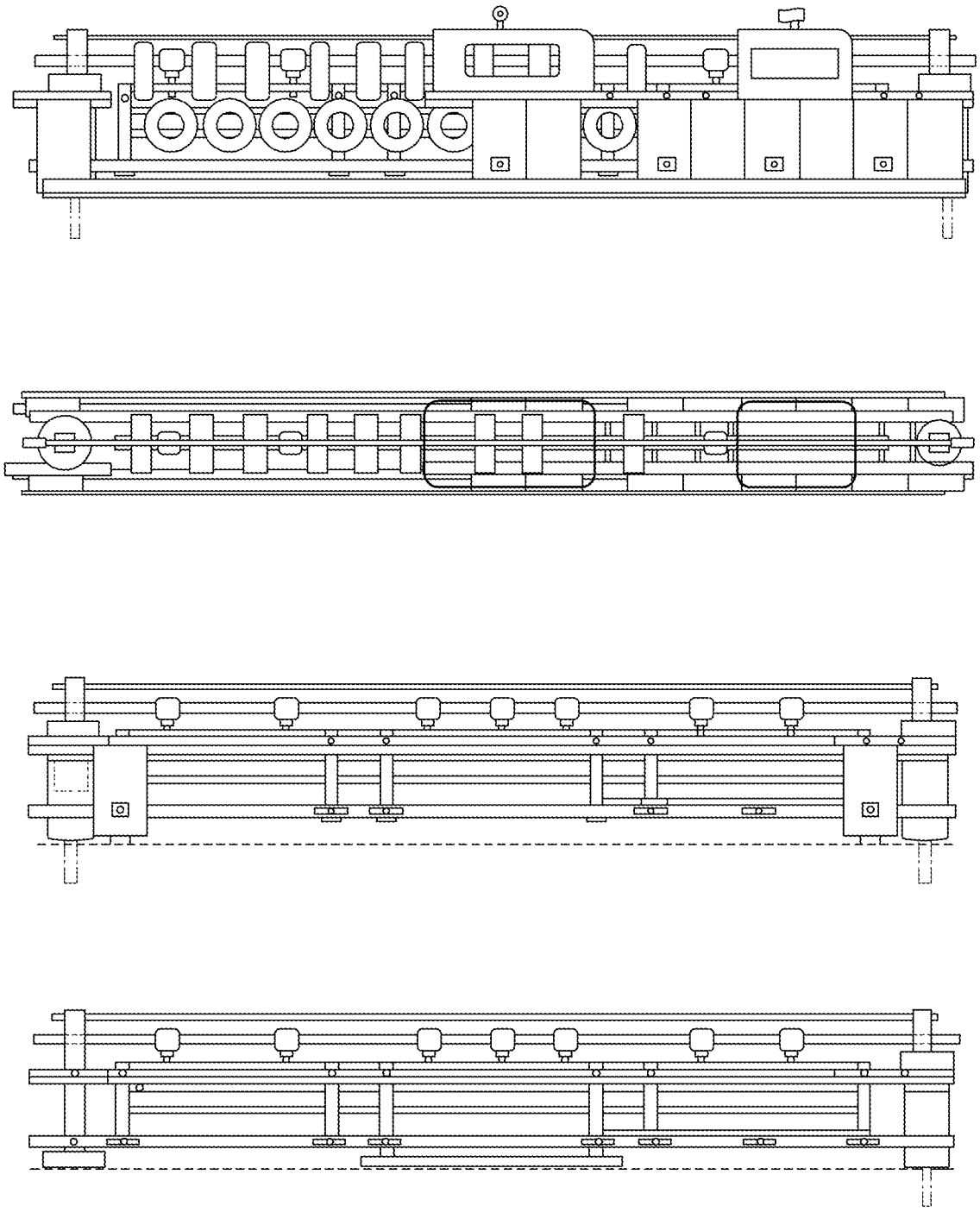
FIG. 5 is an exemplary view showing the shock-absorbing barrier according to the present invention installed in a linear section of a road.
Figure 6:
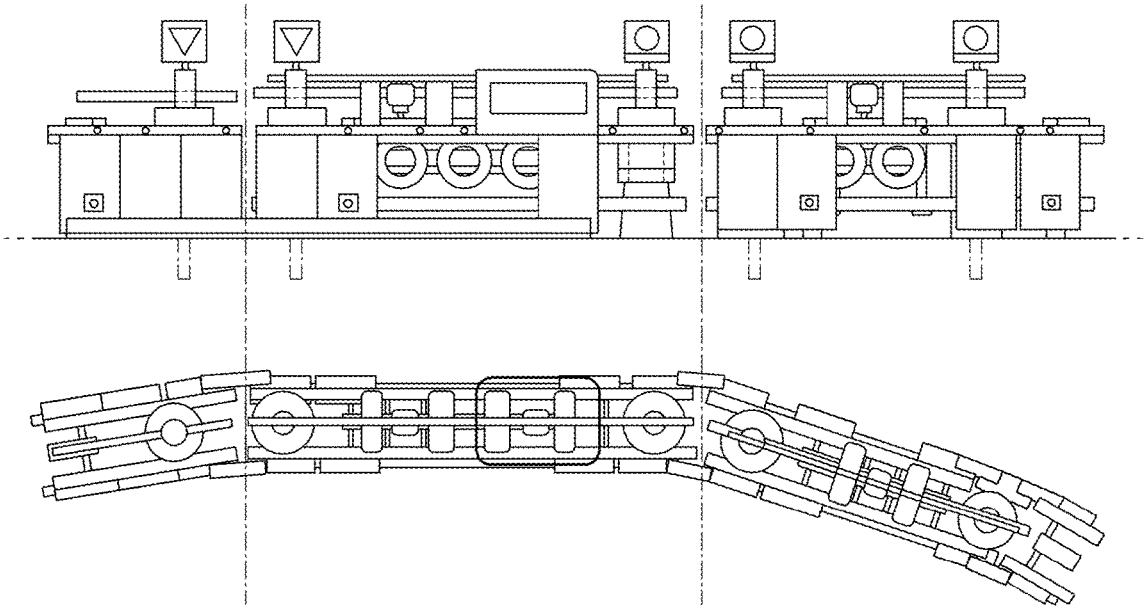
FIG. 6 is an exemplary view showing the shock-absorbing barrier according to the present invention installed in a curved section of a road.

FIG. 5 is an exemplary view showing the shock-absorbing barrier according to the present invention installed in a linear section of a road, and FIG. 6 is an exemplary view showing the shock-absorbing barrier according to the present invention installed in a curved section of a road.

If the use of the pillar 80 as the support base of the guardrail is not proper, for example, if a soil support base is weak or a concrete block is needed according to road characteristics, a base plate having a shape of a bridge base plate (which is shown in FIG. 2 of Korean Patent No. 10-1997-0062203) can be used as the pillar 80, and as shown in FIG. 5, in this case, the bridge base plate is coupled just to the underside of the pillar tube 50 or the vertical tube 40, thereby constituting the guardrail pillar body.

Figure 7:
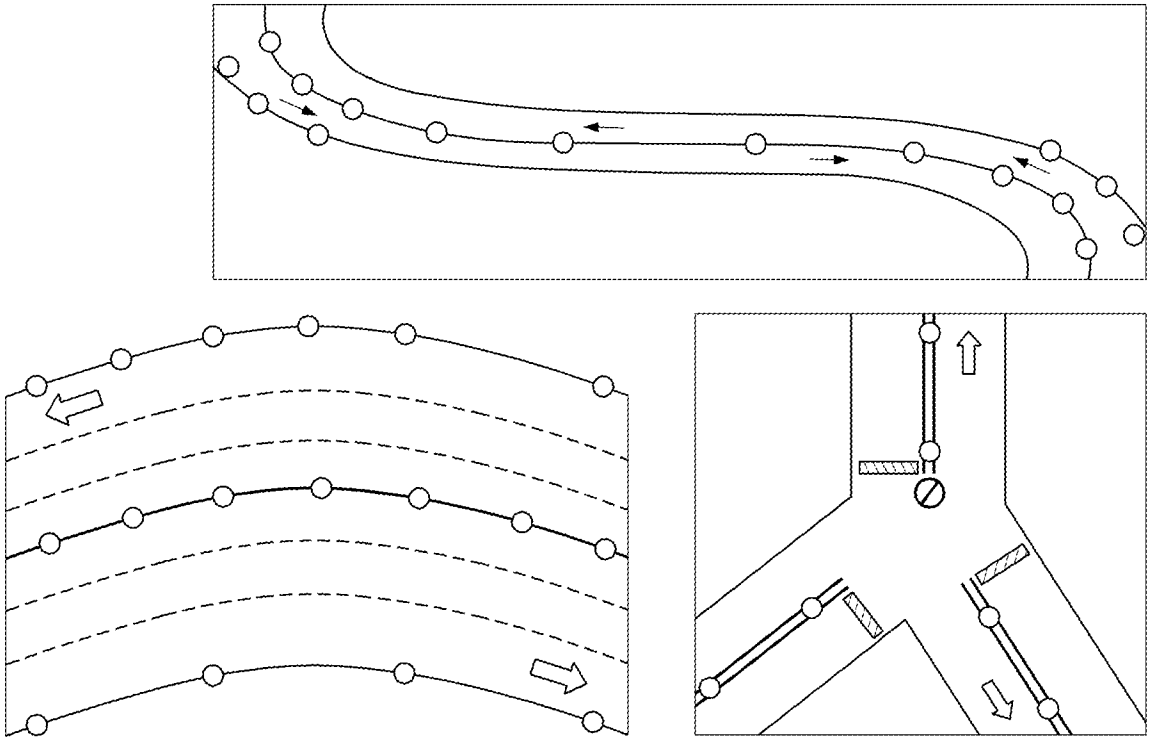
FIG. 7 is an exemplary view showing examples of the pillar bodies applied to various sections in the shock-absorbing barrier according to the present invention.

FIG. 7 is an exemplary view showing examples of the pillar bodies applied to various sections in the shock-absorbing barrier according to the present invention.

In constituting the pillar bodies, the installation positions of the pillar bodies and the number of pillar bodies are determined according to the shapes of the road, so that the number of pillar bodies is increased in proportion to the curves of the roads and the pillar bodies are also densely located on a center line or left turn section.

The present invention relates to the shock-absorbing barrier having an emphasis on the shock-absorbing effects upon the occurrence of safety accidents on roads, and of course, the shock-absorbing barrier may be usefully used as an eco-friendly structure in places having various purposes.

As described above, the shock-absorbing barrier according to the present invention improves the shock-absorbing effects thereof to prevent the occurrence of large-scale accidents and provides appropriate arrangements of the pillars according to the shapes of the road to decrease the rates of the pillars and concrete blocks used, thereby reducing the construction cost thereof.

In addition, the shock-absorbing barrier according to the present invention recycles the waste tires generally used as the shock-absorbing members to their original shapes, makes use of various shock-absorbing members together with the waste tires, and easily completes the installation of the barrier walls and accessories.

While the present invention has been described with reference to the particular illustrative embodiments, it is not to be restricted by the embodiments but only by the appended claims. It is to be appreciated that those skilled in the art can change or modify the embodiments without departing from the scope and spirit of the present invention.

What is claimed is:

1. A shock-absorbing barrier comprising:

a pillar tube (50) coupled to an upper portion of a pillar (80) mounted to the ground;

a pillar tube rail (90) transversely-extending through the pillar tube (50); and a guardrail shock-absorbing part comprising:

a pair of axially-aligned guardrails (10) extending parallel to the pillar tube rail (90) on opposing sides of the pillar (80), each guardrail (10) being connected to the pillar tube rail (90) via a respective rotary rod (12) vertically coupled therebetween;

a plurality of axially-aligned hollow shock-absorbing members (51) having the pillar tube rail (90) and the guardrails (10) extending therethrough;

a plurality of axially-aligned barrier walls (60) disposed on each opposing side of the shock-absorbing members (51);

a plurality of vertical tubes (40) connected to the guardrails (10) and extending downwardly therefrom about respective transverse axes;

a pair of horizontal rails (30) extending parallel to the guardrails (10) on opposing sides of the vertical tubes (40) and coupled to lower portions of the vertical tubes (40) via horizontal rods (42) which pass through the vertical tubes (40) and aligned horizontal holes (31) in the horizontal rails (30), and wherein the horizontal rails (30) each pass through aligned cavities in the barrier walls (60) disposed on a respective side of the shock-absorbing members (51); and a pair of barrier rails (20) extending parallel to the guardrails (10) on opposing sides of the vertical tubes (40) and coupled to upper portions of the vertical tubes (40) via horizontal shaft fixing rods (21), and wherein the barrier rails (20) each pass through aligned rail grooves (65) formed on top surfaces of the respective barrier walls (60).

2. The shock-absorbing barrier according to claim 1, wherein horizontal rod sockets (41) rotatably couple the horizontal rods (42) to the vertical tubes (40) so that the horizontal rails (30) coupled to both ends of each of the horizontal rods (42) around rotary shafts of the horizontal rod sockets (41) are shear-deformed by an external collision, and the compression force of the horizontal rod (42) twisting the horizontal rails (30) is shock-absorbed by means of the elastic recovering tension of the horizontal rails (30) and the barrier rails (20).

3. The shock-absorbing barrier according to claim 1, wherein each rotary rod (12) has a rotary rod socket (13) disposed on a coupling portion thereof to the pillar tube rail (90) so that if an external collision occurs, the rotary rod (12) is changed to a shape of a cone around the axis of the pillar tube rail (90) to extend a shock-absorbing section thereof toward the inside of the barrier walls (60), and the guardrail shock-absorbing part is recovered vertically by means of the tension of opposing end coupling portions of each rotary rod (12).

4. The shock-absorbing barrier according to claim 1, wherein the pillar tube (50) has shock-absorbing bumpers (70) disposed thereon and a cover rail (100) transversely extends above the pillar tube (50) parallel to the pillar tube rail (90), and wherein the cover rail (100) provides a cover line to the shock-absorbing bumpers (70) and the shock absorbing members (51) surrounding the pillar tube rail (90), the shock-absorbing members (51) have a given shape capable of accommodating the guardrails (10) and the pillar tube rail (90) therethrough.

5. The shock-absorbing barrier according to claim 1, wherein a line support stand (83) is located on the sides of the barrier walls (60) to prevent the barrier walls (60) from being deviated from a barrier wall boundary.

* * * * *